US009377749B2

(12) United States Patent
Saito

(10) Patent No.: US 9,377,749 B2
(45) Date of Patent: Jun. 28, 2016

(54) IMAGE FORMING APPARATUS

(71) Applicant: CANON KABUSHIKI KAISHA, Tokyo (JP)

(72) Inventor: Kazuhiro Saito, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/538,612

(22) Filed: Nov. 11, 2014

(65) Prior Publication Data

US 2015/0130127 A1 May 14, 2015

(30) Foreign Application Priority Data

Nov. 14, 2013 (WO) ..... PCT/JP2013/080754

(51) Int. Cl.

| | |
|---|---|
| ***G03G 21/16*** | (2006.01) |
| ***B65H 29/12*** | (2006.01) |
| ***B65H 29/52*** | (2006.01) |
| ***B65H 85/00*** | (2006.01) |
| ***B65H 5/06*** | (2006.01) |

(52) U.S. Cl.

CPC ..... *G03G 21/1633* (2013.01); *B65H 5/062* (2013.01); *B65H 29/125* (2013.01); *B65H 29/52* (2013.01); *B65H 85/00* (2013.01); *G03G 21/1638* (2013.01); *B65H 2402/441* (2013.01); *B65H 2404/611* (2013.01); *B65H 2601/11* (2013.01); *B65H 2601/321* (2013.01); *B65H 2801/12* (2013.01)

(58) Field of Classification Search

CPC ..... G03G 21/1633; G03G 21/1638; G03G 2215/00544; B65H 2402/441

See application file for complete search history.

(56) References Cited

U.S. PATENT DOCUMENTS

| | | | | |
|---|---|---|---|---|
| 8,315,539 | B2 * | 11/2012 | Uehara | 399/124 |
| 2007/0091157 | A1 * | 4/2007 | Ito | 347/104 |
| 2014/0340460 | A1 * | 11/2014 | Sugizaki | 347/179 |

FOREIGN PATENT DOCUMENTS

| | | | |
|---|---|---|---|
| JP | 62-248886 | A | 10/1987 |
| JP | 2001-278524 | A | 10/2001 |
| JP | 2004-123393 | A | 4/2004 |
| JP | 2004-361495 | A | 12/2004 |
| JP | 2005-070223 | A | 3/2005 |
| JP | 2006-232525 | A | 9/2006 |

* cited by examiner

*Primary Examiner* — Luis A Gonzalez

(74) *Attorney, Agent, or Firm* — Canon USA, Inc. IP Division

(57) ABSTRACT

The image forming apparatus includes a first guide that defines a conveyance path and rotates about a fulcrum with the opening of the cover, the fulcrum being provided at a lower portion of the first guide, the conveyance path extending upward and downward and through which the sheet is conveyed; and a second guide that defines the conveyance path in combination with the first guide, the second guide being rotatable with the cover being open. The second guide moves in a direction away from the fulcrum with the opening of the cover.

14 Claims, 9 Drawing Sheets

IMAGE FORMING APPARATUS

TECHNICAL FIELD

The present disclosure relates to an image forming apparatus that forms an image on a sheet.

BACKGROUND ART

An image forming apparatus includes a sheet conveyance path in which an image is formed on one side of a sheet, and a re-conveyance path through which the sheet is conveyed to an image forming unit again so that another image is formed on the other side of the sheet. If a jam or the like occurs and a sheet is stuck in the re-conveyance path, a jam-clearance cover is opened and the sheet that has been stuck is removed. PTL 1 proposes a technology in which the center of rotation of a jam-clearance cover is defined below a re-conveyance path, and the jam-clearance cover is opened in a direction away from an apparatus body.

CITATION LIST

Patent Literature

PTL 1 Japanese Patent Application No. 62-248886

In the above known technology, although a wide space for jam clearance can be provided in an upper portion of the conveyance path that is far from the center of rotation of the jam-clearance cover, there is a problem in that it is difficult to clear a jam that may occur in a narrow space near the center of rotation.

Accordingly, the present invention provides an image forming apparatus having high jam-clearing capability.

SUMMARY

An image forming apparatus according to the present disclosure includes image forming means that forms an image on a sheet. The image forming apparatus includes a cover openably and closably provided on one lateral-side portion of the image forming apparatus; a first guide that defines a conveyance path and rotates about a fulcrum with the opening of the cover, the fulcrum being provided at a lower portion of the first guide, the conveyance path extending upward and downward and through which the sheet is conveyed; and a second guide provided at a farther position from the one lateral-side portion than the first guide and that defines the conveyance path in combination with the first guide, the second guide being rotatable with the cover being open. The second guide is movable in a direction away from the fulcrum.

Further features of the present invention will become apparent from the following description of exemplary embodiments with reference to the attached drawings.

DESCRIPTION OF EMBODIMENTS

First Embodiment

A monochrome printer as an image forming apparatus according to an embodiment of the present disclosure will now be described. The present disclosure is not limited to a monochrome printer and is also applicable to image forming apparatuses such as a full-color multifunction machine.

Description of Outline Configuration of Image Forming Apparatus

Figure 2:
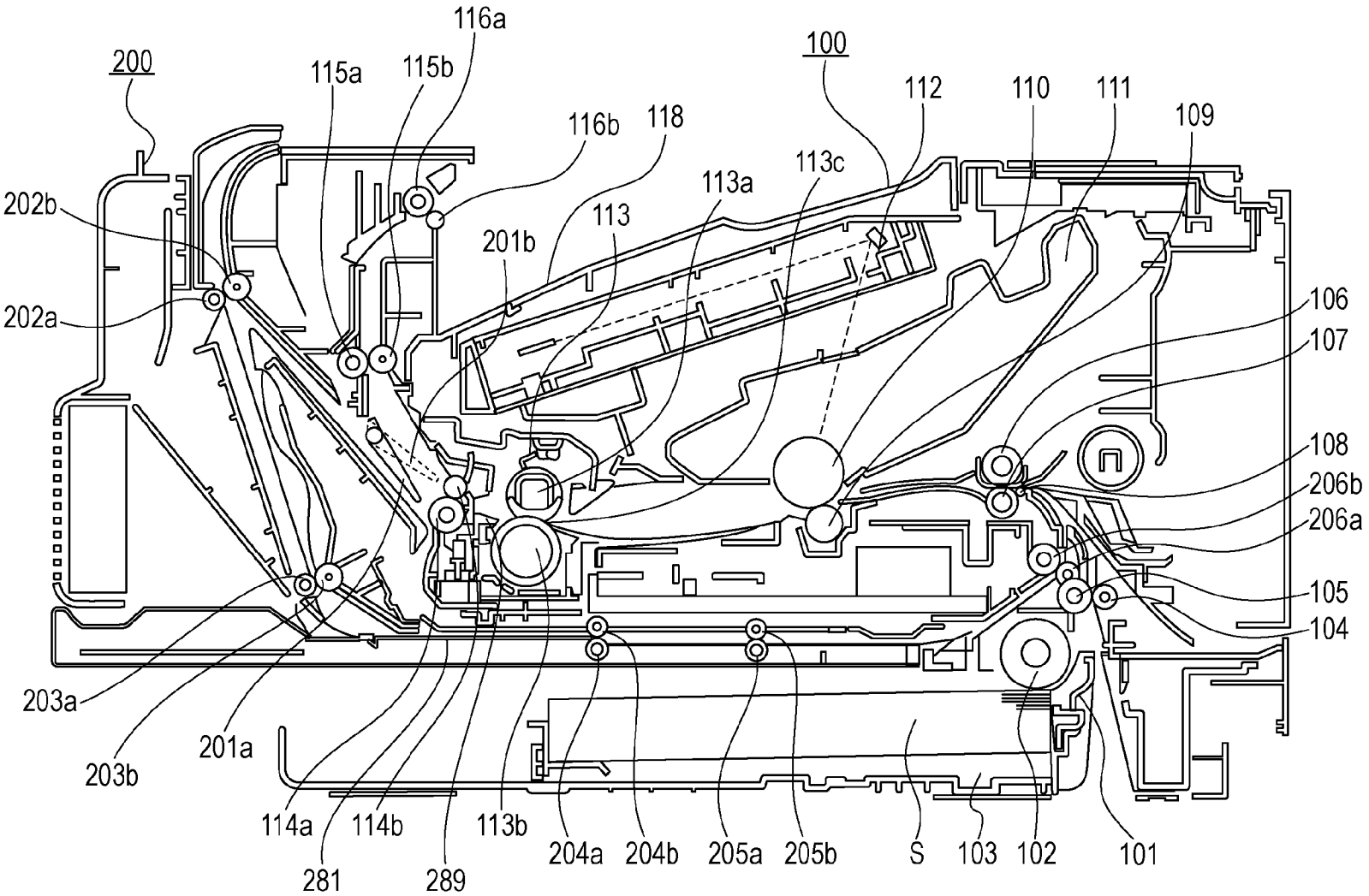
FIG. 2 is a sectional view illustrating an overall configuration of the image forming apparatus.

First, an outline configuration of the image forming apparatus will be described with reference to FIG. 2, following the course of conveyance of a sheet as a recording medium.

In the image forming apparatus, a feed roller 102 facing a separating pad 101 feeds sheets S, which are stacked and stored in a sheet cassette 103, one by one toward the downstream side in a direction of conveyance. The sheet S thus fed by the feed roller 102 is conveyed to a registration roller 107, which faces a registration runner 106, by a conveying roller 105, which faces a conveyance runner 104. The registration runner 106 is provided with a registration shutter 108. The registration shutter 108 is rotatable coaxially with the registration runner 106 and corrects the skew of the sheet S conveyed thereto.

Then, the registration roller 107 conveys the sheet S to a transfer roller 109. A process cartridge 111 holds a photoconductor drum 110 and a developing device (not illustrated). Developer is supplied to a latent image that has been formed on the photoconductor drum 110 with laser light applied thereto from a scanner unit 112, whereby a visual image is formed. The visual image is transferred to the sheet S by the transfer roller 109 but is yet to be fixed.

The sheet S having the visual image transferred thereto is conveyed to a fixing unit 113 as a fixing device, and is subject to heat and pressure at a fixing nip part 113*c* formed by a heating unit 113*a* as a fixing member that is pressed against a pressure roller 113*b*, whereby the visual image is fixed on the upper sheet S.

The photoconductor drum 110, the transfer roller 109, and the fixing unit 113 constitute an image forming unit that forms an image on a sheet.

The sheet S having the image fixed thereon is conveyed by a pair of FU discharge rollers 114*a* and 114*b* while being guided by a post-fixing guide 289, and is guided upward by a flapper 201*a* that is at a position illustrated by solid lines. Subsequently, the sheet S is conveyed from a pair of intermediate discharge rollers 115*a* and 115*b* to a pair of FD discharge rollers 116*a* and 116*b*. Then, from a discharge port, the sheet S is stacked onto a FD tray 118 as a stacking portion on which the sheet is stacked with a side thereof having an image facing downward.

If images are to be formed on two respective sides of the sheet S, the sheet S is conveyed by the pair of FU discharge rollers 114*a* and 114*b* while being guided by the post-fixing guide 289. The sheet that is being conveyed by the pair of FU discharge rollers 114*a* and 114*b* is guided to a duplex unit 200 by a flapper 201*b* that is at a position illustrated by dotted lines. The post-fixing guide 289 and the pair of FU discharge rollers 114*a* and 114*b* constitute a guide unit that guides the sheet having the image fixed thereon to the duplex unit 200.

The duplex unit 200 includes a pair of reversing rollers 202*a* and 202*b* provided above the fixing nip part 113*c* and that reverse and convey the sheet. The sheet S is conveyed to a reversing nip formed between the pair of reversing rollers 202*a* and 202*b* in the duplex unit 200. Then, with a reversing operation (an operation of changing the direction of conveyance to the opposite direction) of the pair of reversing rollers 202*a* and 202*b*, the sheet S is conveyed to a pair of duplex first rollers 203*a* and 203*b*. Subsequently, the sheet S is conveyed through a re-conveyance path 281, which is provided below the fixing nip part 113*c*, by a pair of duplex second rollers 204*a* and 204*b* and a pair of duplex third rollers 205*a* and 205*b*. The sheet having been conveyed through the re-conveyance path 281 is conveyed to a pair of duplex fourth rollers 206*a* and 206*b* and is conveyed to the pair of registration rollers 106 and 107 again. Subsequently, an image is formed on the other side of the sheet, and the sheet is discharged from the discharge port to the FD tray 118 by the pair of FD discharge rollers 116*a* and 116*b*.

Outline Configuration of Duplex Unit

Figure 3:
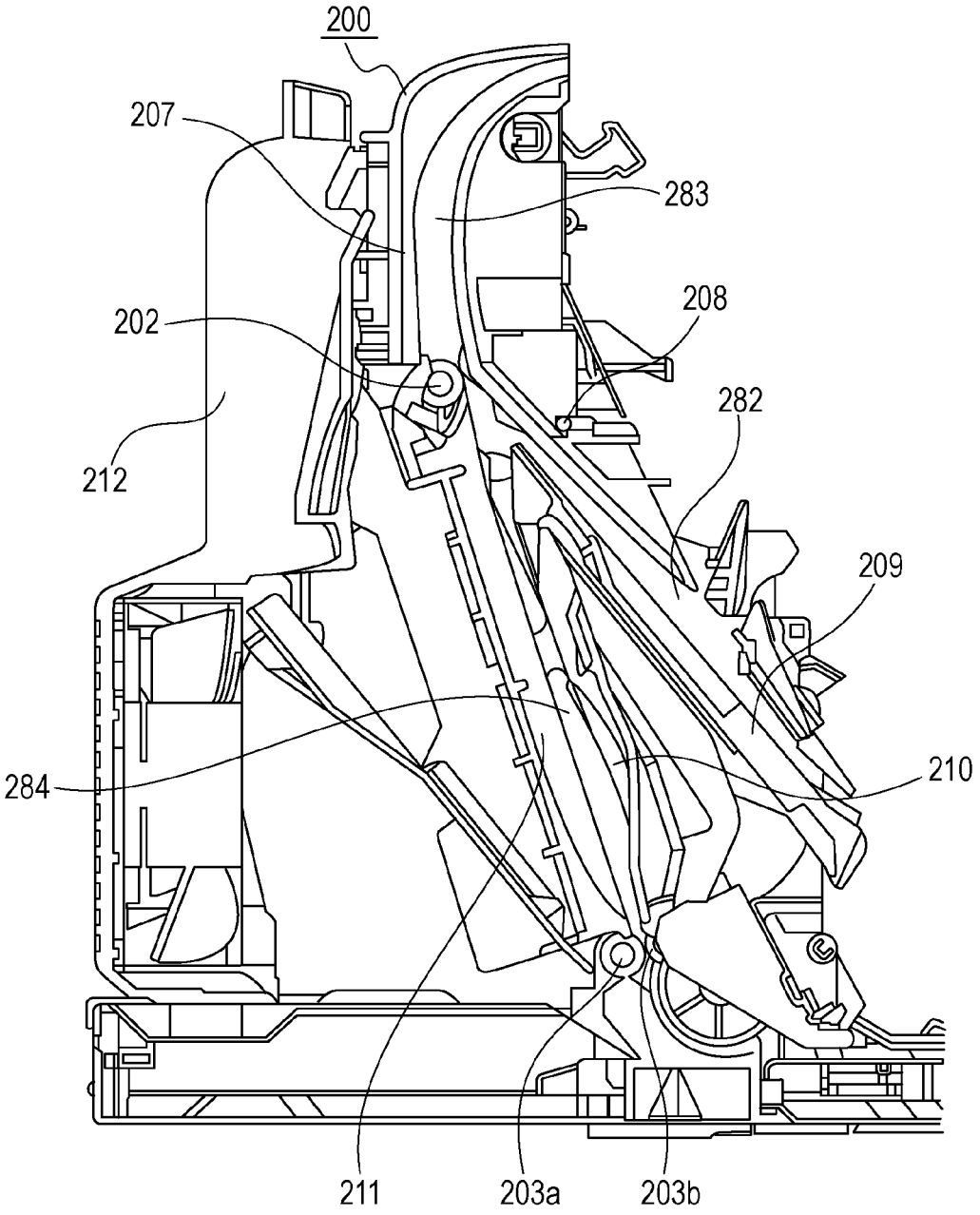
FIG. 3 is a sectional view illustrating a configuration of a duplex unit.

FIG. 3 is a sectional view illustrating the configuration of the duplex unit 200 provided on the downstream side with respect to the fixing unit 113. The sheet is guided from the fixing unit 113 to the pair of reversing rollers 202 through a pre-reversal conveyance path 282 defined by a lower guide 209 as a pre-reversal guide and an inner reversal guide 208. A reversal conveyance path 283 for guiding the sheet received from the fixing unit 113 is provided above the pair of reversing rollers 202. The reversal conveyance path 283 is defined by an outer reversal guide 207 and the inner reversal guide 208.

Figure 1:
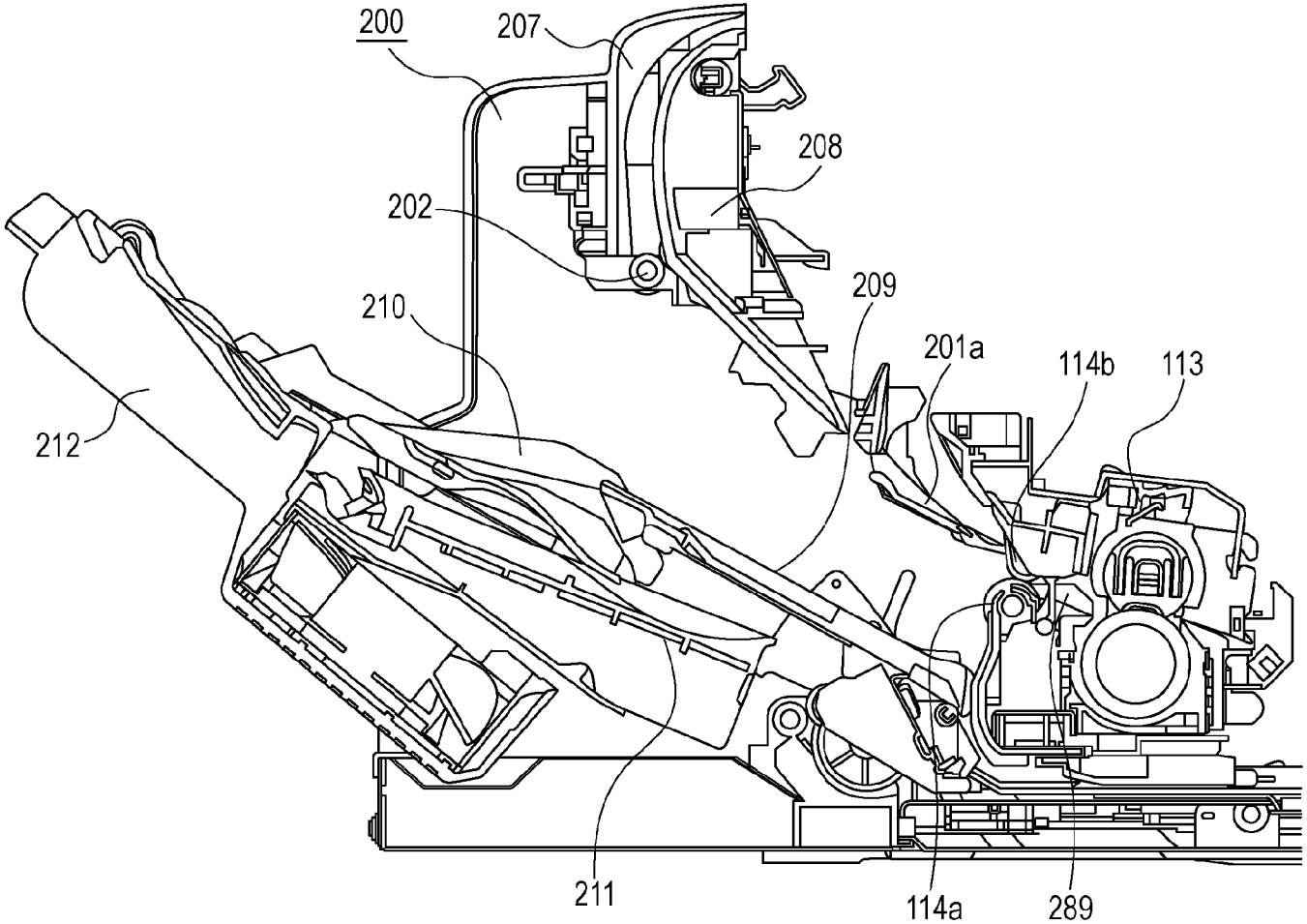
FIG. 1 is a sectional view illustrating a configuration of an image forming apparatus according to an embodiment disclosed herein.

A post-reversal conveyance path 284 is provided below the pair of reversing rollers 202. The post-reversal conveyance path 284 is a conveyance path that extends toward upward and downward in such a manner as to guide the sheet having been reversed by the pair of reversing rollers 202 toward the lower side. That is, after the direction of conveyance is reversed by the pair of reversing rollers 202, the sheet that is being conveyed toward the pair of duplex first rollers 203*a* and 203*b* by the pair of reversing rollers 202 goes through the post-reversal conveyance path 284. The post-reversal conveyance path 284 is defined by an outer guide 211 as a first guide and a middle guide 210 as a second guide. The cover 212, which is opened as illustrated in FIG. 1 when a jam is cleared, is provided on the outer side (one lateral side of a printer body 100, i.e., the left side in FIG. 1) of the outer guide 211. The lower guide 209, the middle guide 210, the outer guide 211, and the cover 212 are movably and rotatably supported. Detailed configurations and behaviors of the lower guide 209, the middle guide 210, the outer guide 211, and the cover 212 will be described below.

Description of Cover and Guides

Figure 4B:
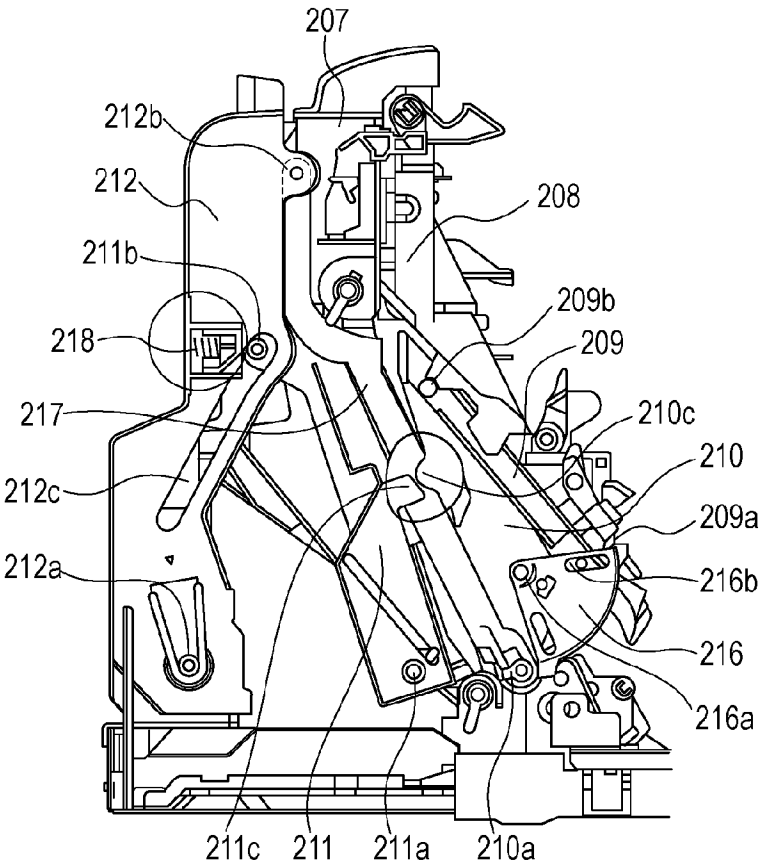
FIGS. 4A and 4B are diagrams illustrating the image forming apparatus.
Figure 4A:
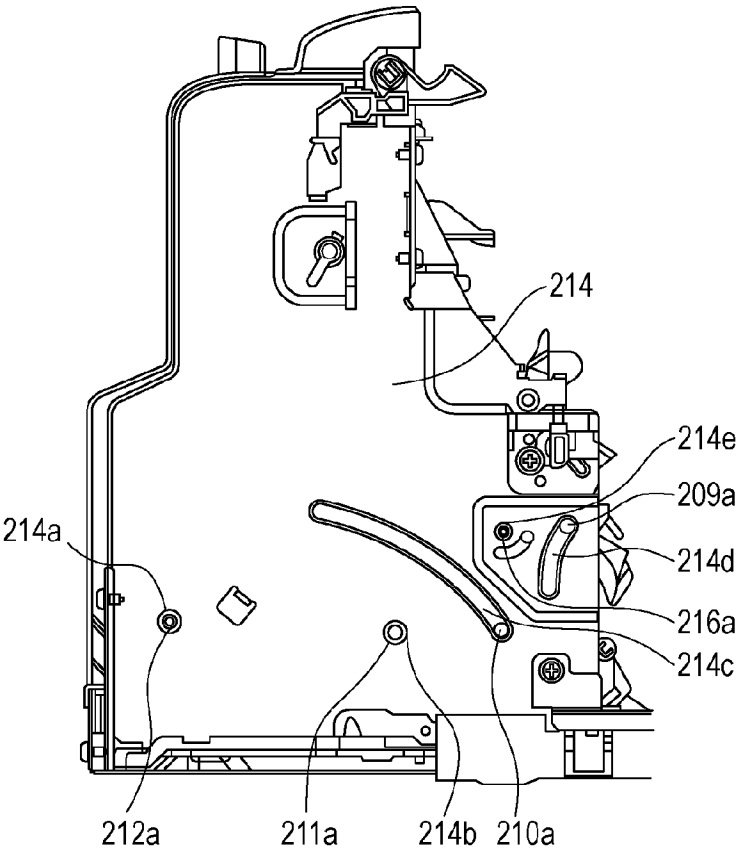

The lower guide 209, the middle guide 210, the outer guide 211, and the cover 212 are held by a frame 214, by which the pair of reversing rollers 202 and the pair of duplex first rollers 203*a* and 203*b* are rotatably supported. FIG. 4A is a diagram illustrating the shape of the frame 214 of the duplex unit 200. FIG. 4B is a diagram illustrating the inner side of the frame 214.

The cover 212 is openably and closably provided on one lateral-side portion of the printer body 100. The cover 212 has a rotational shaft 212*a* at a lower portion thereof. The rotational shaft 212*a* of the cover 212 is rotatably supported in a hole 214*a* of the frame 214. An upper portion of the cover 212 is locked by a locking member (not illustrated) rotatably supported by the outer reversal guide 207.

The outer guide 211 has a rotational shaft 211*a* at a lower portion thereof. The rotational shaft 211*a* of the outer guide 211 functions as a fulcrum for the rotation of the outer guide 211 and is rotatably supported in a hole 214*b* of the frame 214. A boss 211*b* provided at an upper portion of the outer guide 211 engages with a long narrow slit (long hole) 212*c* provided in the cover 212. Since the boss 211*b* of the outer guide 211 engages with the slit 212*c* of the cover 212, the outer guide 211 behaves in conjunction with the opening and closing of the cover 212.

In a state where the cover 212 is closed, the outer guide 211 is urged toward the printer body 100 by an elastic force exerted by a spring unit 218 provided on the cover 212 and engaging with the boss 211*b*. In the state where the cover 212 is closed, the outer guide 211 is retained at a predetermined position with a stopper 211*c* of the outer guide 211 being in contact with a projection 210*c* of the middle guide 210.

The middle guide 210 has a rotational shaft 210*a* at a lower portion thereof. The rotational shaft 210*a* of the middle guide 210 engages with an arc-shaped slit (long hole) 214 provided in the frame 214. The rotational shaft 210*a* of the middle guide 210 is connected to a boss 212*b* with a link 217 interposed therebetween. The boss 212*b* is provided on a side face of the cover 212. That is, the middle guide 210 behaves in conjunction with the opening and closing of the cover 212 with the aid of the link (link portion) 217 as interlocking means. In the state where the cover 212 is closed, the middle guide 210 is retained by the link 217 with the rotational shaft 210*a* thereof being in contact with an end of the slit 214*c* of the frame 214. In the state where the cover 212 is closed, as described above, the stopper 211*c* of the outer guide 211 is in contact with the projection 210*c* provided at an upper portion of the side face of the middle guide 210, whereby the middle guide 210 is urged toward the printer body 100 by the outer guide 211. In the state where the cover 212 is closed, the middle guide 210 is retained at a predetermined position by being in contact with a positioning pin 209*b* provided on the lower guide 209. In a state where the cover 212 is open, the rotational shaft 210*a* of the middle guide 210 is supported by an end portion of the link 217 and the slit 214*c* of the frame 214, whereby the middle guide 210 is rotatable.

The lower guide 209 has a rotational shaft 209*a* at a lower portion thereof. The rotational shaft 209*a* of the lower guide 209 engages with an arc-shaped slit 214*d* provided in the frame 214. The rotational shaft 209*a* of the lower guide 209 engages with a slit 216*b* provided in a lifter 216 that is swingably supported in a hole 214*e* provided in the frame 214. The lifter 216 as a lifting member is in contact with an outer circumferential surface (contact portion) of the link 217 that engages with the rotational shaft 210*a* of the middle guide 210. In the state where the cover 212 is closed, the link 217 prevents the lifter 216 from rotating clockwise. In the state where the cover 212 is closed, the slit 216*b* of the lifter 216 extends substantially orthogonal to the arc-shaped slit 214*d* of the frame 214. That is, in the state where the cover 212 is closed, the rotational shaft 209*a* of the lower guide 209 is supported at the intersection of the respective slits of the lifter 216 and the frame 214.

In the state where the cover 212 is closed, the positioning pin 209*b* provided at an upper portion of the lower guide 209 is urged upward by the middle guide 210 described above. In the state where the cover 212 is closed, the lower guide 209 is retained at a predetermined position by being in contact with the inner reversal guide 208.

Behaviors of Conveyance Guides Taken Along with Opening/Closing of Cover

Behaviors of the guides that are taken when the cover 212 is rotated so as to be open will now be described with reference to FIGS. 5A and 5B. When the user pulls a grip 212*d* of the cover 212 toward the left side in the drawings, the locking member (not illustrated) of the outer reversal guide 207 is released, whereby the cover opens.

A projection 212*e* provided on a side face of the cover 212 comes into contact with a stopper 214*f* provided on the frame 214, whereby the cover 212 is retained in such a manner as to be open at a predetermined maximum angle.

With the opening of the cover 212, the boss 211*b* of the outer guide 211 moves downward along the slit 212*c* of the cover 212, whereby the outer guide 211 rotates about the rotational shaft 211*a* in the same direction as the rotation of the cover 212. Thus, the outer guide 211 is retained in such a manner as to be open at a predetermined maximum angle, as with the cover 212.

When the cover 212 is opened, the outer guide 211 having urged the upper portion of the middle guide 210 is retracted. Hence, the middle guide 210 rotates under its own weight in the same direction (the counterclockwise direction) as the rotation of the outer guide 211. With the opening of the cover 212, the rotational shaft 210*a* of the middle guide 210 moves along the slit 214*c* of the frame 214 with the aid of the link 217 connected to the cover 212. Since the rotational shaft 210*a* of the middle guide 210 moves along the slit 214*c*, the middle guide 210 moves in a direction away from the printer body 100 (in a direction away from the rotational shaft 211*a* of the outer guide 211) along the outer guide 211. That is, with the opening of the cover 212, the middle guide 210 moves toward the upper left along and relative to the outer guide 211 while rotating in the counterclockwise direction.

The above description concerns an exemplary case where the middle guide 210 has the shaft 210*a* and the frame 214 has the slit 214*c* so as to move the middle guide 210 toward the upper left with the opening of the cover 212. Alternatively, the middle guide 210 may have a slit and the frame 214 may have a shaft to be fitted in the slit so that the middle guide 210 can be moved with the opening of the cover 212.

When the cover 212 is opened, the middle guide 210 having urged the upper portion of the lower guide 209 is retracted. Hence, the lower guide 209 rotates under its own weight in the same direction (the counterclockwise direction) as the rotation of the middle guide 210. With the opening of the cover 212, the link 217 having been in contact with the lifter 216 is retracted. Hence, the lifter 216 rotates in the clockwise direction. Thus, the lower guide 209 moves downward under its own weight along the slit 214*d* of the frame 214. Then, the rotational shaft 209 of the lower guide 209 comes into contact with the end of the slit 214*d* of the frame 214, whereby the lower guide 209 stops moving. That is, with the opening of the cover 212, the lower guide 209 rotates, and an upstream end portion of the lower guide 209 moves downward with respect to the post-fixing guide 289 and the pair of FU discharge rollers 114*a* and 114*b*.

Figure 5B:
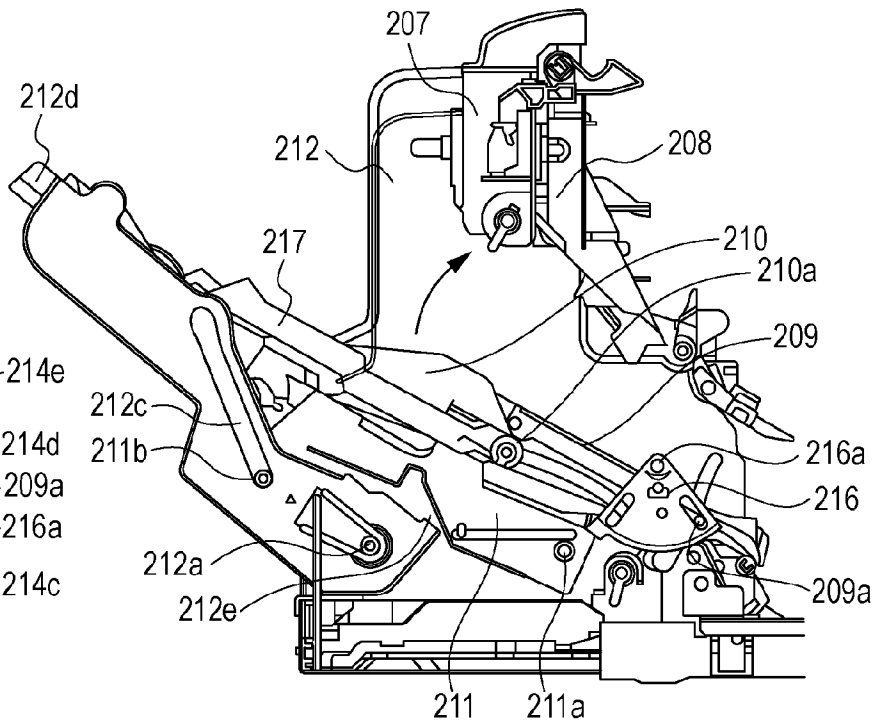
FIGS. 5A and 5B are diagrams illustrating the image forming apparatus.
Figure 5A:
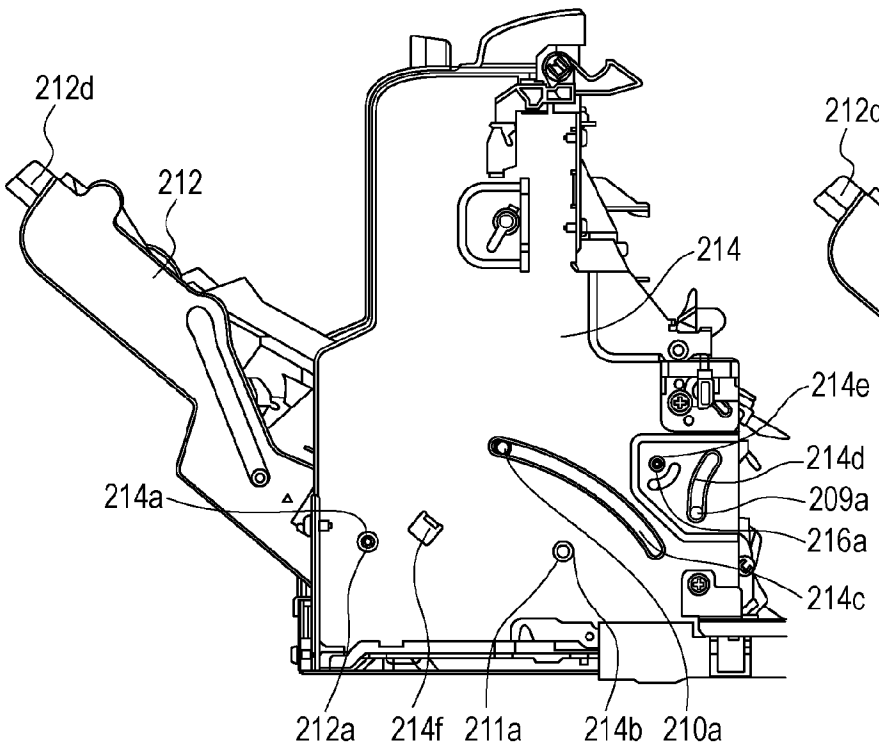

In the state where the cover 212 is open at the maximum angle, the middle guide 210 and the lower guide 209 are rotatable in a direction represented by an arrow illustrated in FIG. 5B.

Description of Jam Clearance

Figure 6:
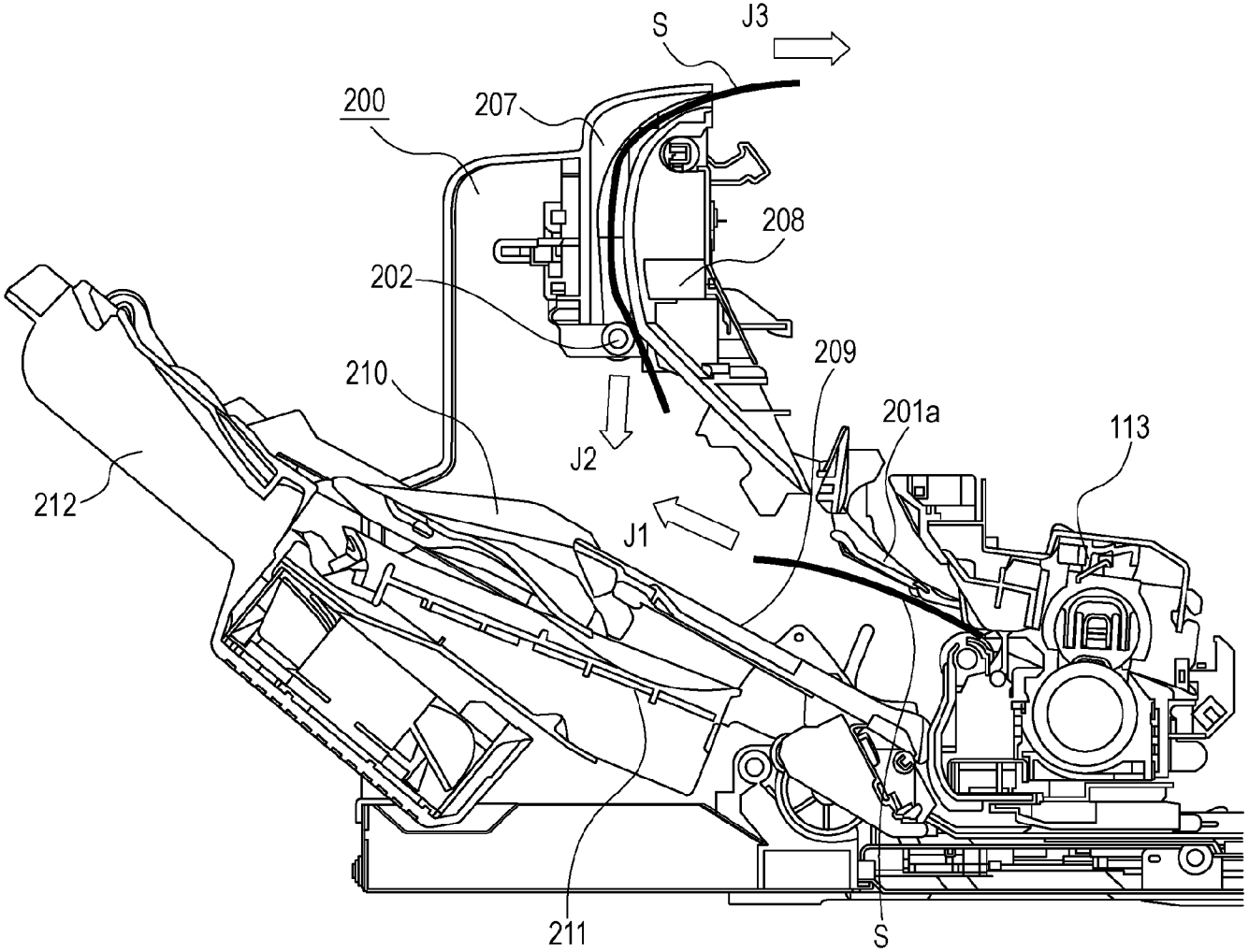
FIG. 6 is a sectional view illustrating a method of clearing a jam occurring in the image forming apparatus.

First, a case will be described with reference to FIG. 6 in which a sheet S is stuck in the pre-reversal conveyance path that is on the upstream side with respect to the pair of reversing rollers 202. Since the cover 212 is opened and the upstream end portion of the lower guide 209 is moved downward, a satisfactory space for jam clearance is provided. Hence, the jam can be easily cleared by pulling the sheet S in the direction of conveyance (a direction J1). Since a space provided by the movement of the middle guide 210 toward the upper left is utilized so as to move the lower guide 209 downward, the lower guide 209 can be moved downward satisfactorily.

Another case will be described in which a sheet S is stuck while being nipped between the pair of reversing rollers 202. In such a case, the jam is cleared by pulling the sheet S toward the upstream side (in a direction J2) or toward the downstream side (in a direction J3). When the sheet S is pulled in the direction (J2) toward the upstream side, a satisfactorily wide space is provided for jam clearance with the downward movement of the lower guide 209. Hence, the jam can be cleared easily.

Figure 7:
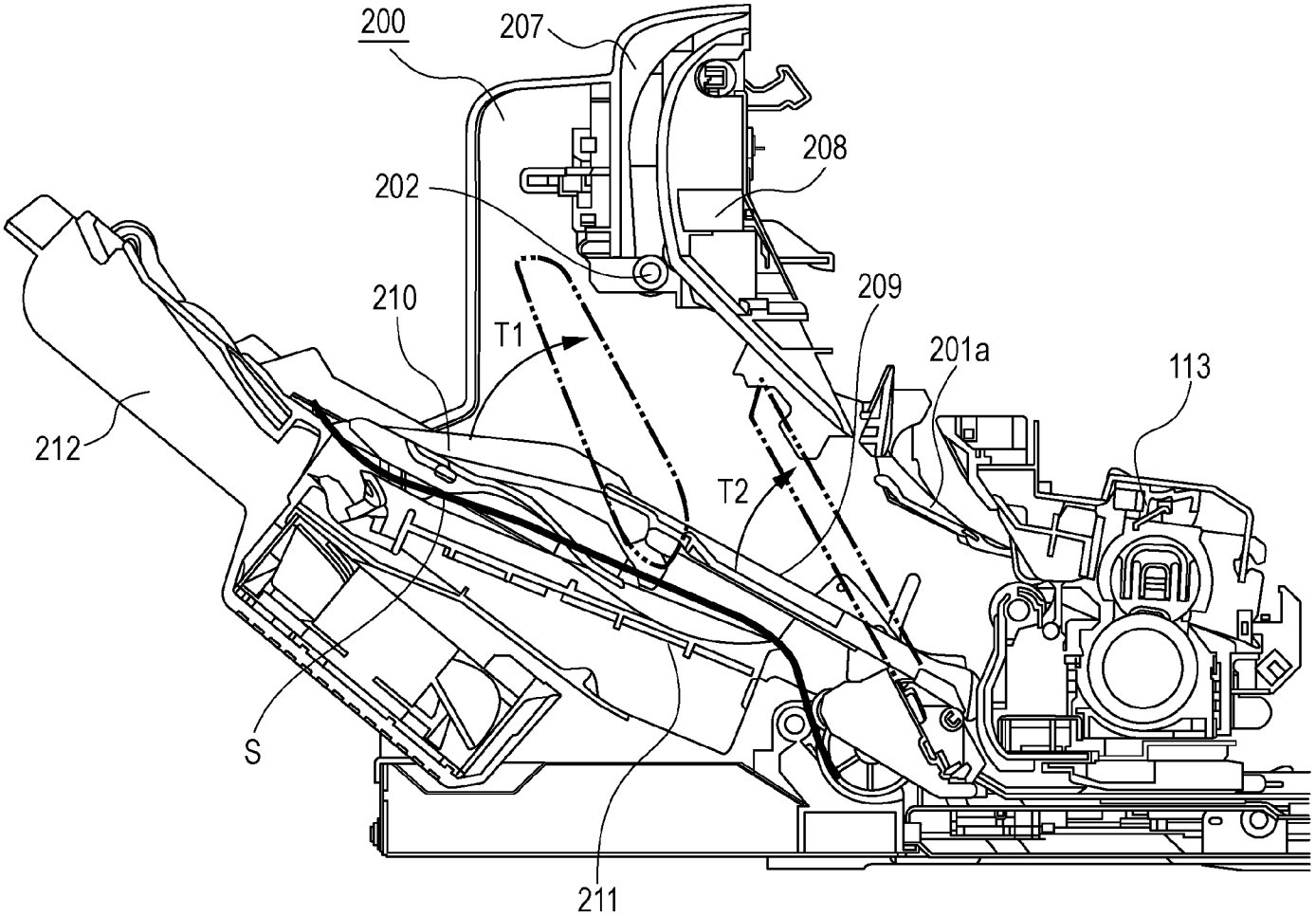
FIG. 7 is another sectional view illustrating the method of clearing a jam occurring in the image forming apparatus.

Yet another case will be described with reference to FIG. 7 in which a sheet S is stuck in the post-reversal conveyance path 284 that is on the downstream side with respect to the pair of reversing rollers 202. As represented by dash-dot-dot lines in the drawing, the middle guide 210 and the lower guide 209 are rotatable in T1 and T2 directions, respectively. Therefore, a wide space for jam clearance is provided, and the jam can be cleared easily.

That is, when the cover 212 is opened, the middle guide 210 moves toward the upper left (in a direction away from the rotational shaft 211*a* of the outer guide 211) and comes closer to an end portion of the cover 212. Hence, the middle guide 210 can be easily opened in the direction T1. Moreover, the angle by which the middle guide 210 is openable is increased. Thus, the jam can be cleared easily. Furthermore, since the lower guide 209 has been moved downward, the lower guide 209 can be opened by a large angle in the direction T2. Thus, the jam can be cleared easily.

Advantageous effects produced by the middle guide 210 that moves toward the upper left with the opening of the cover 212 will now be described in comparison with a comparative example illustrated in FIGS. 9A and 9B. In a configuration illustrated in FIGS. 9A and 9B, an image is formed on a sheet by an image forming unit 301. When duplex printing is to be performed, the sheet is conveyed through a duplex path R. If a sheet is stuck in the duplex path R because of a jam or the like, a door 151 is first opened as illustrated in FIG. 9B. The door 151 rotates about a rotational shaft 151*a* provided at a lower portion thereof. Then, an inner guide 152 is opened up to a position illustrated by dash-dot-dot lines. The inner guide rotates about a rotational shaft 152*a* provided at a lower portion thereof. The space for jam clearance becomes narrower toward the rotational shaft 152*a*. Therefore, if a sheet is stuck at a position R1 illustrated in FIG. 9B, it is difficult not only to clear the jam but also to visually check the jam. Hence, for example, when it is attempted to clear the jam, the sheet may be torn and a portion of the sheet (a sheet chip) may remain in the conveyance path. Such a sheet chip tends to be overlooked by the worker and may cause another jam. This may lead to another problem that, to remove the sheet chip, many components need to be removed.

Figure 9A:
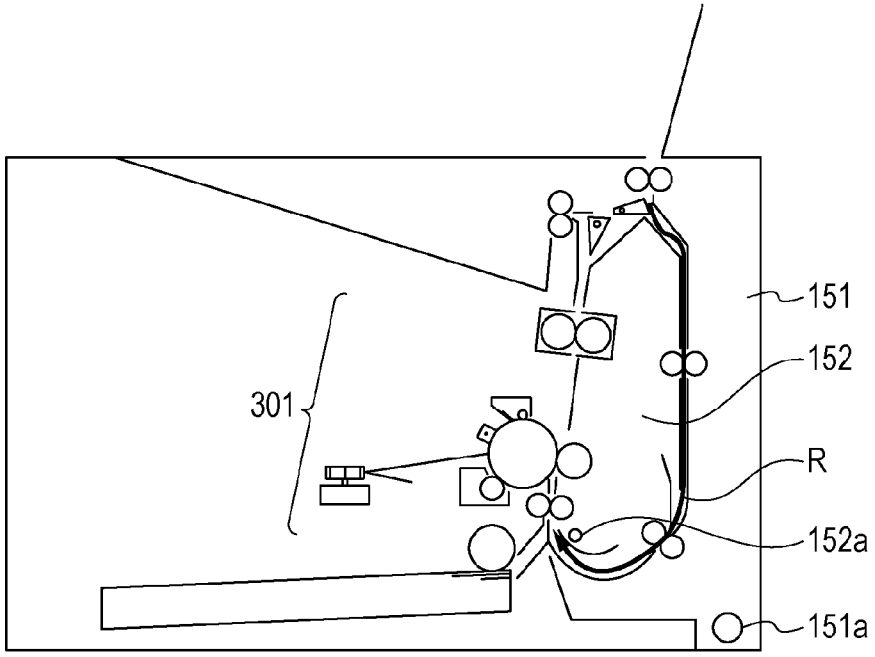
FIGS. 9A and 9B are sectional views illustrating a comparative example.
Figure 9B:
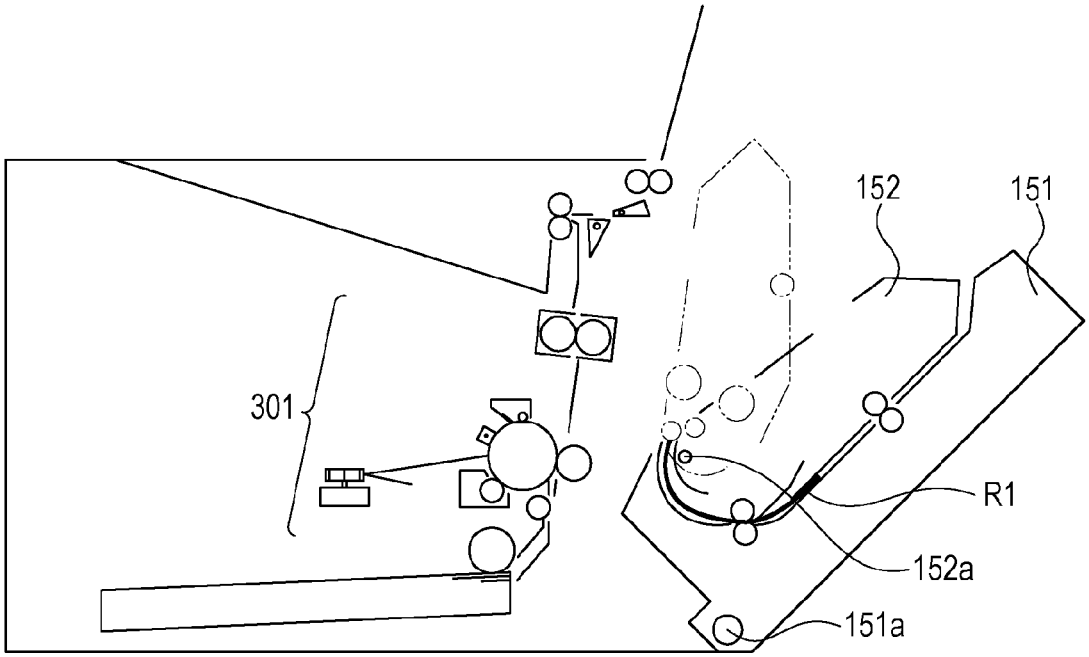

In contrast to the configuration illustrated in FIGS. 9A and 9B, in the first embodiment, the middle guide 210 moves toward the upper left with the opening of the cover 212. In the state where the cover 212 is opened as illustrated in FIG. 7, the shaft 210*a* functioning as the center of rotation of the middle guide 210 to be opened in the direction T1 has been moved upward. Therefore, the angle by which the middle guide 210 is openable is large enough to easily clear the jam and to provide high visibility.

As described above, if a sheet is stuck around the pair of reversing rollers 202 because of a jam or the like, a wide space for jam clearance is provided by opening the cover 212. Thus, the visibility of the sheet and the jam-clearing capability can be improved.

The above description concerns an exemplary case where, when the cover 212 is opened, both the lower guide 209 and the middle guide 210 move. The jam-clearing capability can also be improved in a configuration in which one of the lower guide 209 and the middle guide 210 moves. That is, for example, a configuration in which only the lower guide 209 rotates with the opening of the cover 212 (the upstream end of the lower guide 209 does not move downward) is also acceptable.

Alternatively, the lower guide 209 and the middle guide 210 may be integrated with each other, and a conveyance guide that moves leftward while rotating with the opening of the cover 212 may be provided.

The above description also concerns an exemplary case where, with the cover 212 being open, the rotational shaft 210*a* of the middle guide 210 is rotatably supported by the end portion of the link 217 and the frame 214 (the slit 214*c*) as rotation supporting portions. Alternatively, with the cover 212 being open, the rotational shaft 210*a* of the middle guide 210 may be supported only by the link 217 or only by the frame 214.

The above description also concerns an exemplary case where the outer guide 211 and the cover 212 are rotatable independently of each other about the respective fulcrums. Moreover, the outer guide 211 may be provided on the cover 212. That is, the outer guide 211 that guides the sheet may be provided on the inner side of the cover 212.

Second Embodiment

Figure 8B:
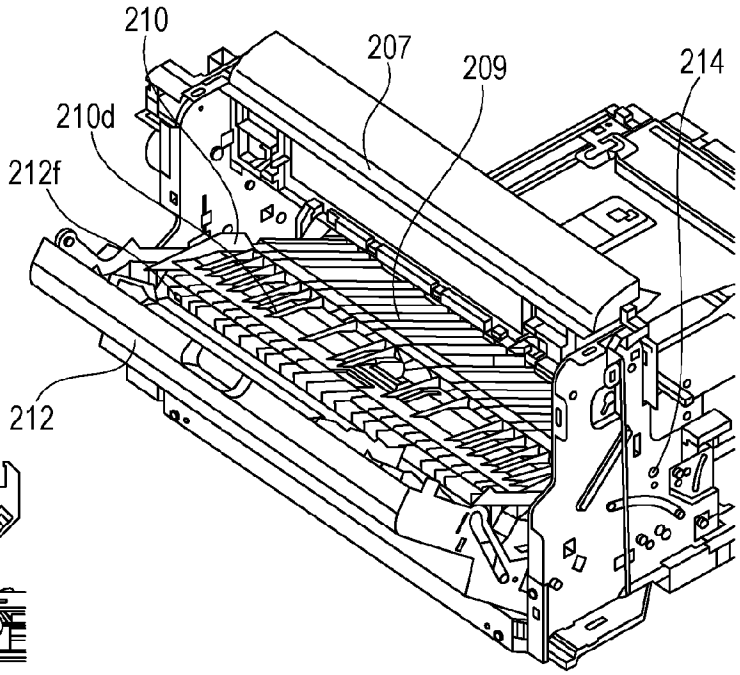
FIGS. 8A and 8B are diagrams illustrating an image forming apparatus.
Figure 8A:
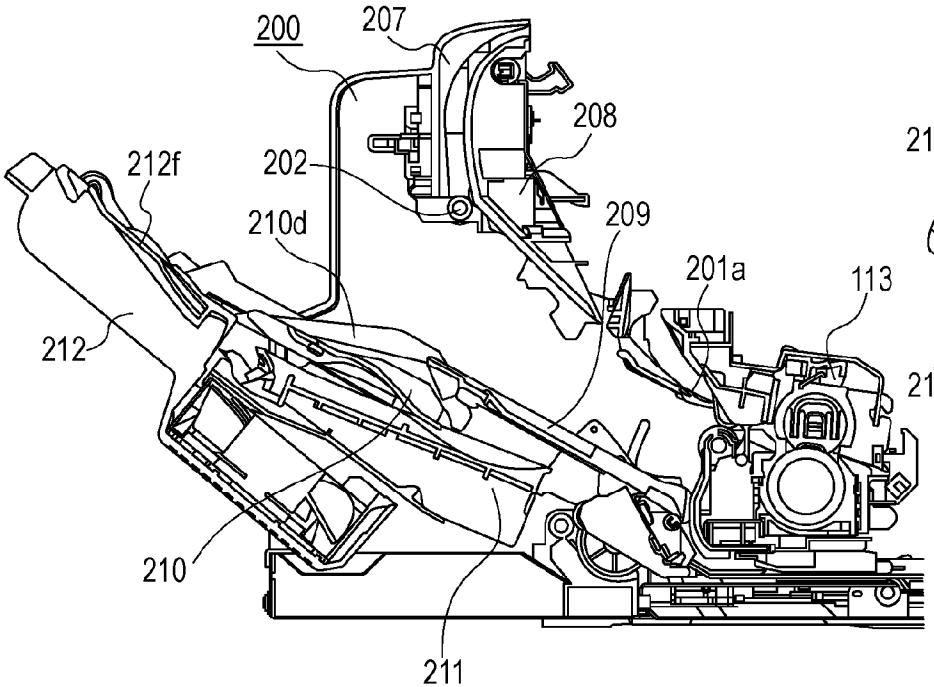

A second embodiment as another embodiment will now be described with reference to FIGS. 8A and 8B. The second embodiment differs from the first embodiment in that the cover 212 has a conveyance guide surface 212*f* at an upper portion thereof, and the middle guide 210 has a conveyance guide surface 210*d* provided on the upper side thereof. The conveyance guide surface 210*d* of the middle guide 210 is provided on a side of the middle guide 210 that is opposite the side defining the post-reversal conveyance path 284. When the cover 212 is opened, the cover 212, the middle guide 210, and the outer guide 211 function as a face-up tray for stacking the sheet having the image formed thereon. That is, when the cover 212 is opened, the sheet discharged from the pair of FU discharge rollers 114*a* and 114*b* is stacked over the conveyance guide surface 210*d* of the cover 212, the conveyance guide surface 210*d* of the middle guide 210, and the outer guide 211.

In a case where an image is formed on a piece of thick paper such as a postcard, if the piece of thick paper is conveyed through a curved conveyance path, the piece of thick paper is strongly brought into contact with the conveyance surface, resulting in a problem that the piece of thick paper may have marks corresponding to conveyance ribs. In a case of coated paper, if the coated paper is conveyed through the pairs of rollers provided on the downstream side of the fixing point, there may be a problem that the piece of coated paper may have marks corresponding to the rollers because of the difference between the surface temperature of the paper and the surface temperature of the rollers. In such an event, the cover 212 is opened, and the sheet is discharged (face-up discharge) by the pair of FU discharge rollers 114*a* and 114*b*. In the face-up discharge, the sheet can be conveyed in a substantially horizontal direction from the point of image formation through the point of fixing to the point of discharge. Such a measure is effective for preventing the occurrence of the marks corresponding to conveyance ribs. Furthermore, in the face-up discharge, the number of rollers that convey the sheet on the downstream side with respect to the fixing unit 113 can be minimized, which is very effective for preventing the occurrence of the marks corresponding to rollers.

Behaviors of the guides that are taken when the cover 212 is rotated are the same as those described in the first embodiment, and description thereof is omitted. When the cover 212 is opened, the upper surface of the lower guide 209, the conveyance guide surface 210*d* as the upper surface of the middle guide 210, and the conveyance guide surface 212*f* of the cover 212 are retained substantially parallel to the direction of conveyance in the fixing unit 113. Since the lower guide 209, the middle guide 210, and the cover 212 come to extend adjacent to one another and function as a face-up tray (a sheet stacking portion), a long sheet can also be stacked thereon. Furthermore, as described in the first embodiment, since the upstream end of the lower guide 209 in the direction of conveyance moves downward, a satisfactorily wide stacking space is provided.

As described above, when the cover 212 is rotated, the lower guide 209, the middle guide 210, and the cover 212 can constitute a large-capacity face-up tray that can receive not only a sheet of a small size, such as a postcard, but also a long sheet.

The present invention is not limited to the above embodiments, and many changes and modifications can be made to the above embodiments without departing from the spirit and scope of the present invention. Hence, to publicize the scope of the present invention, the following claims are provided.

According to the present invention, an image forming apparatus having high jam-clearing capability is provided.

This application claims the benefit of International Patent Application No. PCT/JP2013/080754, filed Nov. 14, 2013, which is hereby incorporated by reference herein in its entirety.

The invention claimed is:

1. An image forming apparatus including image forming means that forms an image on a sheet, the image forming apparatus comprising:

a cover openably and closably provided;

a first guide that rotates about a fulcrum with an opening of the cover;

a second guide that defines a conveyance path in combination with the first guide, the first guide being provided between the cover and the second guide in a state in which the cover is closed, and the second guide being rotatable with the cover being open; and an interlocking portion that interlocks the second guide with the cover such that the second guide moves along the first guide in a direction away from the fulcrum with the opening of the cover.

2. The image forming apparatus according to claim 1, wherein the interlocking portion is a link that connects the cover and the second guide.

3. The image forming apparatus according to claim 1, further comprising:

reversing means that reverses a direction of conveyance of the sheet on which an image has been formed by the image forming means, the reversing means conveying the sheet to the conveyance path;

a pre-reversal conveyance path provided on an opposite side to the cover across the conveyance path and that guides the sheet on which the image has been formed by the image forming means to the reversing means; and a pre-reversal guide that defines the pre-reversal conveyance path and moves such that the pre-reversal conveyance path is opened with the opening of the cover.

4. The image forming apparatus according to claim 3, further comprising:

a guide unit that guides the sheet on which the image has been formed by the image forming means to the pre-reversal conveyance path; and an interlocking unit that interlocks the pre-reversal guide with the opening of the cover such that an upstream end portion of the pre-reversal guide in the direction of conveyance moves downward with respect to the guide unit.

5. The image forming apparatus according to claim 4, wherein the interlocking unit includes a lifting member that supports a rotational shaft provided on the pre-reversal guide, the rotational shaft being rotatably supported, the lifting member being configured to move in such a manner as to cause the rotational shaft to move upward and downward, and a contact portion that is in contact with the lifting member and that moves the lifting member with the opening of the cover.

6. The image forming apparatus according to claim 3, wherein the pre-reversal guide is rotatably supported with the cover being open.

7. The image forming apparatus according to claim 1, further comprising:

a shaft provided on the second guide; and a frame configured to rotatably support the cover and having a slit with which the shaft engages, wherein the shaft moves along the slit of the frame with the opening of the cover.

8. An image forming apparatus including image forming means that forms an image on a sheet, the image forming apparatus comprising:

a cover openably and closably provided;

a first guide that rotates about a fulcrum with an opening of the cover;

a second guide that defines a conveyance path in combination with the first guide, the first guide being provided between the cover and the second guide in a state in which the cover is closed, and the second guide being rotatable with respect to the first guide so that the conveyance path is opened in a state in which the cover is opened;

a shaft provided on the second guide; and a frame configured to rotatably support the cover and having a slit with which the shaft engages, wherein the shaft moves along the slit of the frame with the opening of the cover thereby the second guide is moved in a direction away from the fulcrum.

9. The image forming apparatus according to claim 8, further comprising:

reversing means that reverses a direction of conveyance of the sheet on which an image has been formed by the image forming means, the reversing means conveying the sheet to the conveyance path;

a pre-reversal conveyance path provided on an opposite side to the cover across the conveyance path and that guides the sheet on which the image has been formed by the image forming means to the reversing means; and a pre-reversal guide that defines the pre-reversal conveyance path and moves such that the pre-reversal conveyance path is opened with the opening of the cover.

10. The image forming apparatus according to claim 9, further comprising:

a guide unit that guides the sheet on which the image has been formed by the image forming means to the pre-reversal conveyance path; and an interlocking unit that interlocks the pre-reversal guide with the opening of the cover such that an upstream end portion of the pre-reversal guide in the direction of conveyance moves downward with respect to the guide unit.

11. The image forming apparatus according to claim 10, wherein the interlocking unit includes a lifting member that supports a rotational shaft provided on the pre-reversal guide, the rotational shaft being rotatably supported, the lifting member being configured to move in such a manner as to cause the rotational shaft to move upward and downward; and a contact portion that is in contact with the lifting member and that moves the lifting member with the opening of the cover.

12. The image forming apparatus according to claim 9, wherein the sheet on which the image has been formed is stacked on the pre-reversal guide with the cover being open.

13. The image forming apparatus according to claim 9, wherein the sheet on which the image has been formed is stacked over the pre-reversal guide and the second guide with the cover being open.

14. The image forming apparatus according to claim 9, wherein the pre-reversal guide is rotatably supported with the cover being open.

* * * * *